US005096122A

United States Patent [19]

Abramoska

[11] Patent Number: 5,096,122

[45] Date of Patent: Mar. 17, 1992

[54] SPRAY NOZZLE

[75] Inventor: Alfred A. Abramoska, Medina, Ohio

[73] Assignee: Arthur Products Co., Medina, Ohio

[21] Appl. No.: 528,044

[22] Filed: May 23, 1990

[51] Int. Cl.[5] ..... B05B 3/06

[52] U.S. Cl. ..... 239/252; 239/251

[58] Field of Search ..... 239/101, 251, 252, 256, 239/257, 262, 381, 383

[56] References Cited

U.S. PATENT DOCUMENTS

| | | | |
|---|---|---|---|
| 2,880,938 | 4/1959 | Stewart et al. | 239/252 |
| 3,125,297 | 3/1964 | Copeland et al. | 239/251 |
| 3,684,176 | 8/1972 | Hruby, Jr. | 239/101 |
| 4,089,471 | 5/1978 | Koenig | 239/562 |
| 4,101,075 | 7/1978 | Heitzman | 239/101 |

*Primary Examiner*—Andres Kashnikow
*Assistant Examiner*—Karen B. Merritt
*Attorney, Agent, or Firm*—Oldham & Oldham Co.

[57] ABSTRACT

Spray nozzle for high pressure cleaning. The spray nozzle comprises a stationary body having an inlet portion and a tubular stem or outlet portion, which has therein a bore and a counterbore, respectively; a plurality of laterally extending ports extending from the counterbore to the exterior of the stem portion for discharge of high pressure water; a rotor having aligned tubular end portions defining a bore and a central rib portion of enlarged diameter having an annular channel or reservoir for water therein, and a plurality of orifices extending from said annular channel so configured as to cause self-rotation of the rotor; and an end cap and a machine screw to hold the rotor in place and restrain it from axial movement. Flow restrictors slow down the speed at which the rotor rotates by momentarily obstructing the discharge of water from the ports in the stem portion as the flow restrictors cross the discharge paths. By slowing down the rotational speed of the rotor, flow restrictors increase the amount of energy in the high pressure water streams discharged from the nozzle. The nozzle of this invention is especially useful in high pressure cleaning applications.

7 Claims, 8 Drawing Sheets

SPRAY NOZZLE

TECHNICAL FIELD

This invention relates to spray nozzles and more particularly to a self-rotating spray nozzle for high pressure cleaning.

BACKGROUND ART

Various rotating spray nozzles for high pressure cleaning are known. One example is the nozzle described in U. S. Pat. No. 4,821,961 to Shook. The self-rotating nozzles described therein direct streams of high pressure water in an essentially axial direction. Other self-rotating high pressure spray nozzles, which direct streams of water in an essentially radial direction, are also known. All of the presently self-rotating spray nozzles have shortcomings. One shortcoming, possessed by a number of spray nozzles presently known, is that they consume too much energy to effect high speed rotation, so that the energy of the water streams directed against the object to be cleaned is diminished. Another shortcoming is that many are incapable of directing water with sufficient force to clean all surfaces of the object, especially when the surfaces to be cleaned are interior surfaces and/or the object has an irregular shape.

DISCLOSURE OF THE INVENTION

The present invention provides a high pressure spray nozzle which rotates at relatively low speed, so that most of the energy of the water stream supplied to the nozzle is available for cleaning. The spray nozzle of this invention is also capable of directing a water stream with sufficient force against surfaces in most objects, including those in which the surface is to be cleaned is an interior surface and in which the object is of irregular shape or configuration.

This invention provides a high pressure spray nozzle comprising:

(a) a body having a central axis, an axial bore adapted to be connected to a tubular conduit for high pressure water, a counterbore, a tubular stem portion through which said counterbore extends, and at least one port extending through said stem portion from said counterbore to the exterior of said body;

(b) an annular rotor surrounding the stem portion, said rotor having therein a bore which is in close proximity with the exterior of said stem portion, an annular channel in communication with said at least one port, flow restrictor means extending into said channel and rotating with said rotor for periodically obstructing the flow of water through at least said one port into said channel as said rotor rotates, and a plurality of orifices extending through said rotor from said channel to the exterior of said rotor for discharging high pressure water, said orifices being arranged so as to cause self-rotation of said rotor; and (c) means for restraining said rotor from axial movement and for closing the end of the counterbore which is remote from said bore.

BEST MODE FOR CARRYING OUT THE INVENTION

A preferred embodiment of this invention will now be described in detail with reference to FIGS. 1-4.

Figure 1:
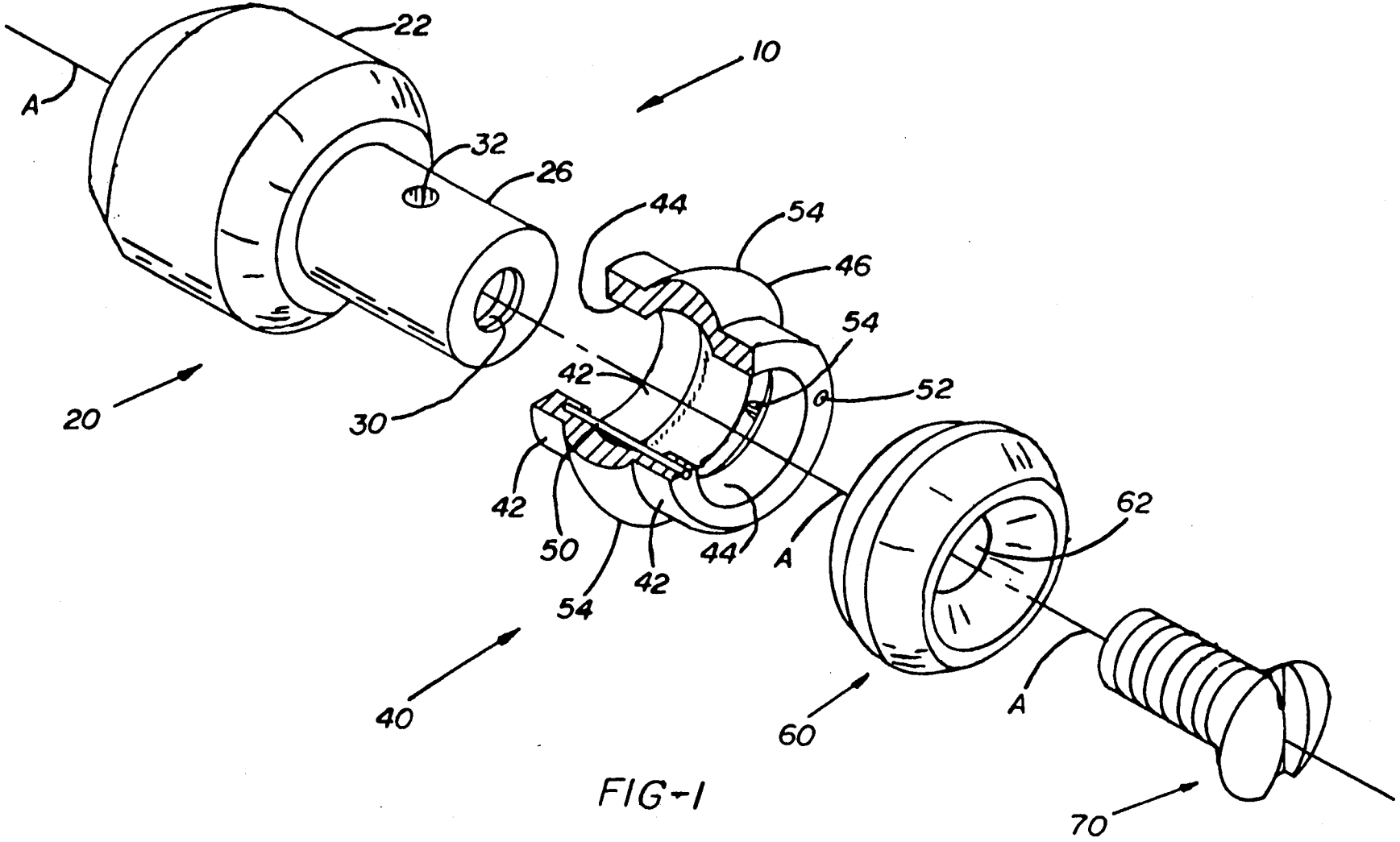
FIG. 1 is a exploded perspective view of the spray nozzle according to a preferred embodiment of this invention.

FIG. 1 is an exploded perspective view showing a preferred spray nozzle 10 of this invention as a whole. As will be noted from FIG. 1, most of the parts comprising spray nozzle 10 are annular and have a common central axis A, which extends in the longitudinal direction of the spray nozzle 10. Spray nozzle 10 comprises an annular body 20, which has axis A as its central axis. Body 20 has a inlet portion 22 which has a screw threaded bore 24 therein, and a tubular outlet or stem portion 26 which has a counterbore 28 therein. Stem portion 26 is of smaller outside diameter than inlet portion 22. Bore 24 and counterbore 28 are concentric; both have axis A as their central axis. The internal screw threads on bore 24 permit the nozzle 10 to be connected to an externally screw threaded tubular conduit for supplying water under high pressure. The posterior portion 30 of counterbore 28 (the portion which is remote from bore 24) is preferably screw threaded to receive a closure member to be hereinafter described. The remaining portion of bore 28 preferably has a smooth cylindrical surface.

A plurality (preferably 7) of equiangularly spaced ports 32 extend laterally through the wall of the outlet portion 26 of annular body 20 for discharge of high pressure water. (Fewer ports 32 are shown for clarity of illustration.) These ports 32 are preferably radial (centered on axis A) and coplanar. The direction of water flow through body 20 is indicated by arrows F. As shown, high pressure water enters nozzle body 20 via bore 24 and flows through counterbore 28, thence outwardly through ports 32.

Spray nozzle 10 also has an annular rotor (or rotary head) 40. Rotor 40 is generally tubular, having two cylindrical wall portions 42 having equal (and uniform) inside diameters and equal (and uniform) and outside diameters, each having a bore 44 which is centered on central axis A, at the two ends of the rotor, with a mid-portion 46 (or rib portion) of enlarged diameter between the two cylindrical end portions 42. This portion 46 of enlarged diameter encloses an annular channel 48, which extends around the circumference of rotor 40. The internal and external wall surfaces of enlarged portion 46 are preferably arcuate and essentially semicircular, although the exact shape of these wall surfaces are not material. Channel 48 provides a reservoir for receiving high pressure water which is discharged from body 20 through ports 32.

The diameter of bore 44 of rotor 40 is just slightly larger than the external diameter of the stem portion 26 of body 20, so as to provide a small clearance. This permits rotor 40 to rotate freely about body 20, which is stationary. A small amount of water which enters the clearance between bore 44 and the outside surface of stem portion 26 of body 20 acts as a lubricant.

Rotor 40 has a plurality of longitudinally extending pins 50 (preferably 2 as shown) which are received in longitudinally extending cylindrical holes 52. Holes 52 are preferably open at one end of rotor 40 and closed at the other, as may be seen best in FIG. 2. Pins 50 are situated close to the outside surface of stem 26, so that they pass close to ports 32 as they rotate. They extend into and across annular channel 48. Pins 50 serve as flow restrictors, which momentarily cross the paths of the water streams discharged through ports 32 as the rotor 40 rotates. As these pins cross the paths of the water streams, they briefly obstruct the flow of water through ports 32 into channel 48. This gives a pulsating effect. It also slows down the rotational speed of rotor 40. It will be noted that the maximum radius of channel 48 is greater than the distance from pins 50 to central axis A, so that at least a portion of channel 48 is disposed radially outwardly of pins 50.

Figure 2:
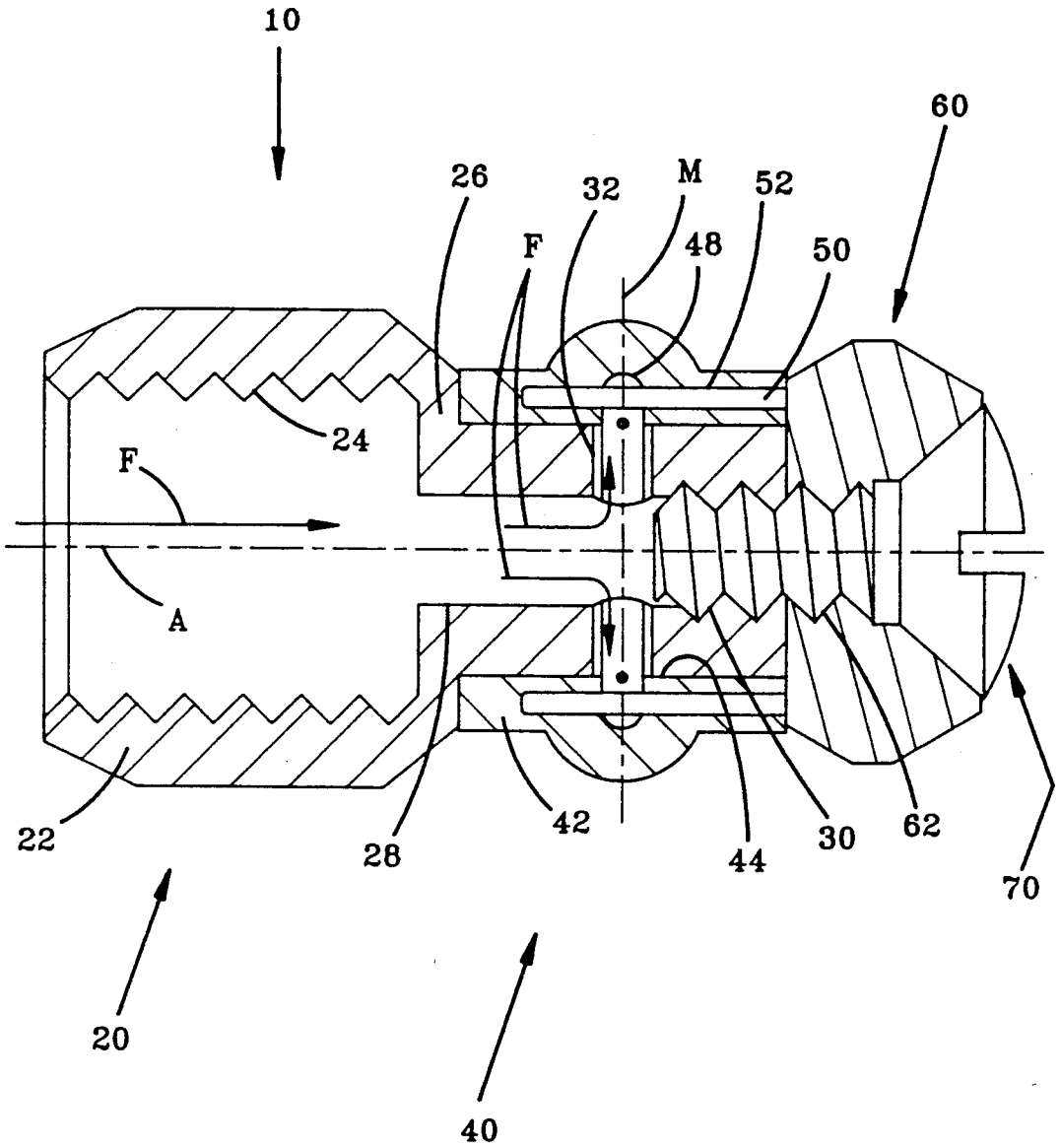
FIG. 2 is a longitudinal sectional view of a spray nozzle according to a preferred embodiment of this invention.
Figure 3:
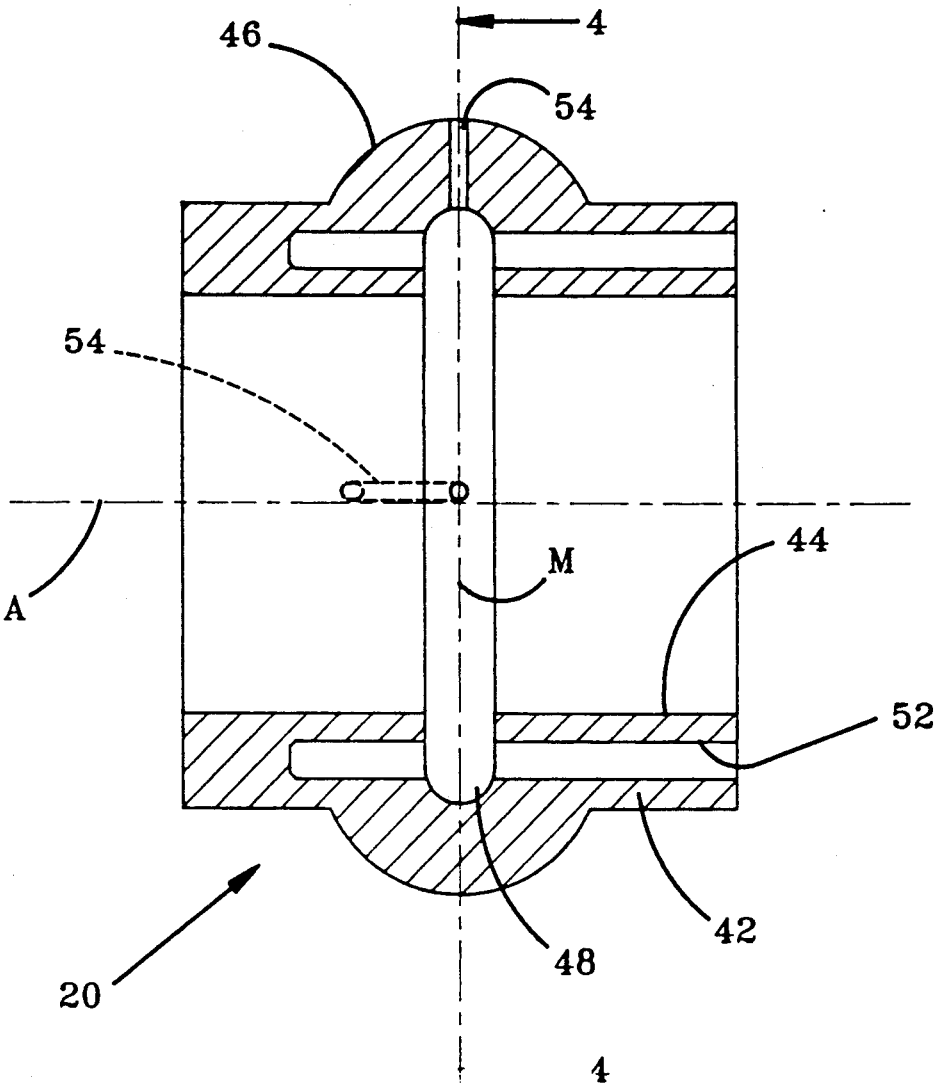
FIG. 3 is a longitudinal sectional view of a rotor according to a preferred embodiment of this invention.
Figure 4:
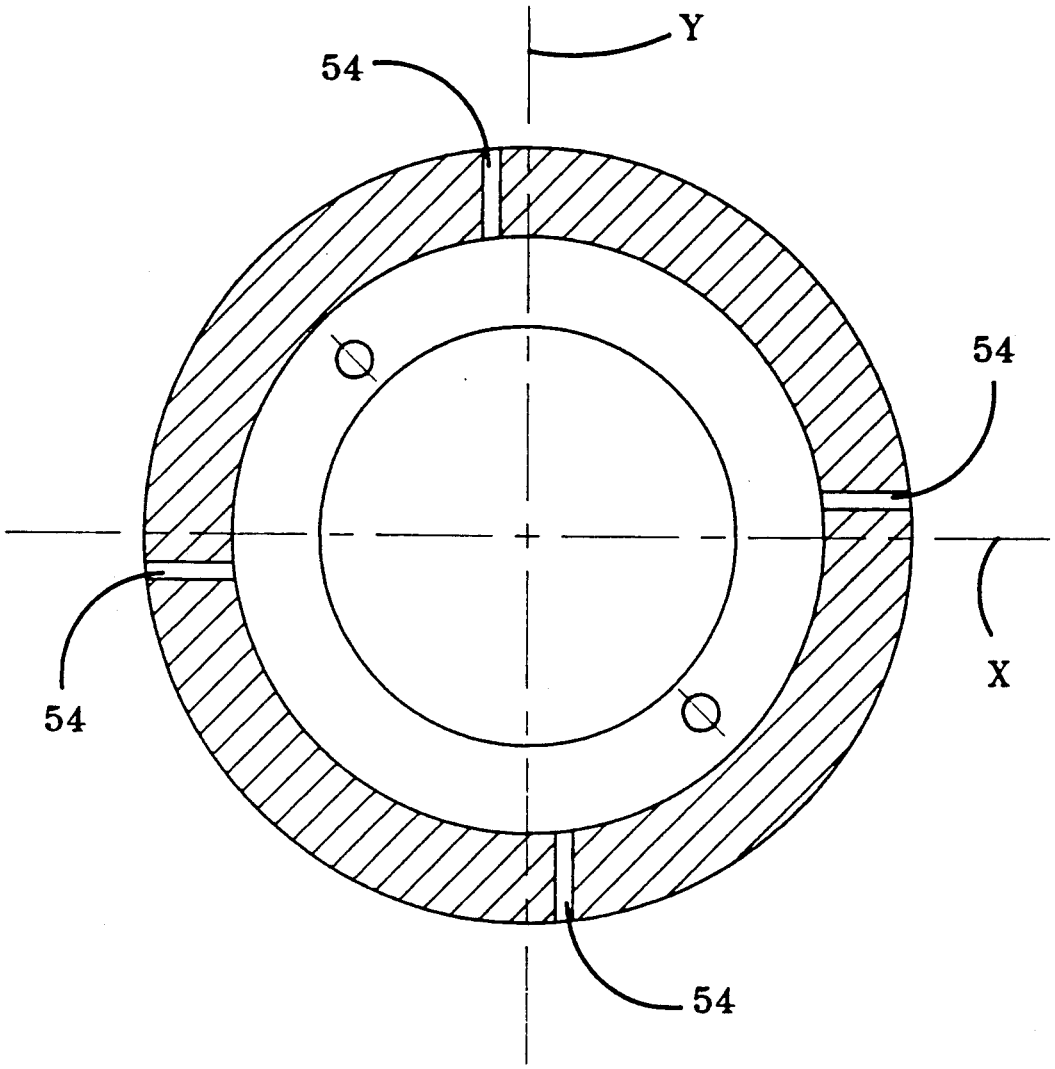
FIG. 4 is a cross-sectional view of the rotor of FIG. 3, taken along lines 4—4 of FIG. 3.

Enlarged portion 46 of rotor 40 has a midplane M, which is perpendicular to central axis A. The trace of midplane M is shown in FIGS. 2 and 3. Enlarged portion 46 is symmetrical with respect to midplane M. Also, the maximum radius of channel 48 and the exterior wall surface of enlarged portion 46 in the embodiment shown (wherein both are arcuate) is at midplane M.

Rotor 40 has a plurality of orifices 54 for discharge of high pressure water. These orifices 54 are in communication with annular channel 48. Orifices 54 are preferably of uniform diameter, which is such as to give the desired outlet pressure for the user's needs. As may be seen best in FIG. 4, orifices 54 (4 are shown therein) are equiangularly spaced about central axis A. They are also all offset by equal small amounts from radii X and Y which extend from central axis A in directions perpendicular thereto. As seen best in FIG. 3, two opposite orifices 54 lie in midplane M. The other two orifices 54 intersect the wall of channel 48 (which is the inside wall of enlarged portion 46) at equal distances from midplane M on opposite sides thereof. All orifices 54 are preferably essentially perpendicular to the outside surface of enlarged portion 46. The configuration of orifices 54 as shown is such as to produce no net thrust in the axial direction (along axis A) (although this is not necessary) or in the radial direction (at right angles to axis A), but do produce a net rotational thrust which will cause rotor 40 to self-rotate when high pressure water is flowing through spray nozzle 10.

Spray nozzle 10 has an annular end cap 60, which has a screw-threaded central bore 62 which is concentric with central axis A. The diameters of bore 62 and the screw-threaded portion 30 of bore 28 of body 20 are the same. End cap 60 restrains rotor 40 from axial movement while permitting it to rotate freely about central axis A. Finally, spray nozzle 10 has an externally threaded machine screw 70 having a threaded stem portion which engages the internal screw-threaded portion 30 of bore 28 as well as the internal screw threads 62 of end cap 60. Screw 70 holds end cap 60 in place.

It will be noted that body 20, rotor 40, end cap 60 and screw 70 all have a common central axis A. It will be further noted that bore 24 and counterbore 28 of body 20 and bore 62 of end cap 60 are all concentric, all being centered on central axis A.

Spray nozzle 10 is adapted to be attached to the downstream end of a tubular conduit (not shown) for high pressure water, so that high pressure water flows from the tubular conduit into the bore 24 of body 20 in the direction shown by arrow F. The screw-threaded connection is shown, but other types of couplings known in the art may be used. The high pressure water stream continues through counterbore 28 and then outwardly through lateral port 32 of body 20, as shown by arrows F. The high pressure streams then flow from port 32 into the annular channel 48 of rotor 40, then outwardly through orifices 54. The nozzle 10 is either held or positioned so that high pressure water, discharged through orifices 54, will be directed against the surface or surfaces to be cleaned. As noted earlier, orifices 54 are positioned so as to cause slow rotation of the rotor about its central axis A and with respect to the stationary tubular stem portion 26 of body 20. Slow rotation is further aided by pins 50. Also, as noted earlier, slow rotation is preferably to rapid rotation because slow rotation consumes less energy, leaving a greater amount of the energy contained in the high pressure water stream available for cleaning. As the rotor 40 rotates, pins 50 periodically cross the paths of the water streams discharged through ports 32. These pins momentarily obstruct the flow of water from ports 32 into annular channel 48, resulting in a reduction in rotational speed and in a pulsating action in the high pressure water streams discharged through orifices 54 as well as into streams flowing into the annular chamber 48. This pulsating action aids in dislodging matter stuck to the surfaces to be cleaned, and thereby aids in cleaning.

Figure 5:
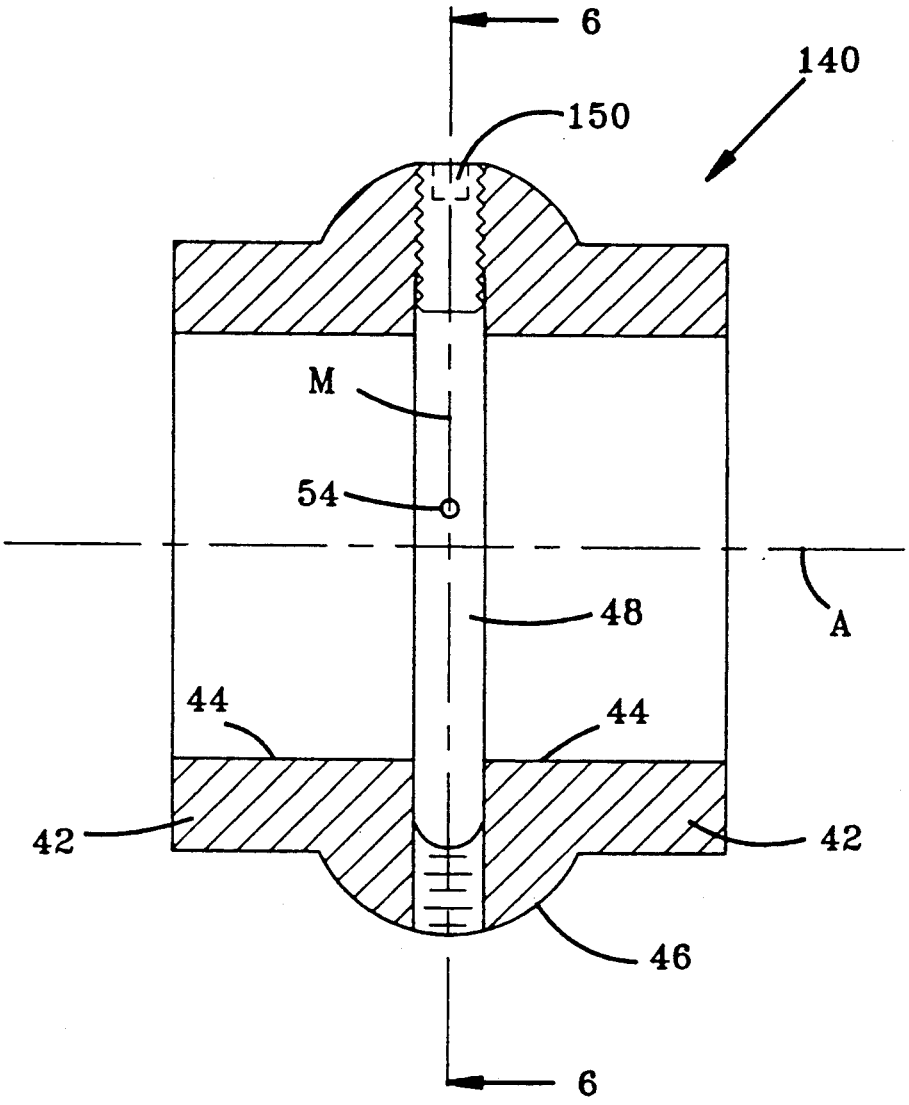
FIG. 5 is a longitudinal sectional view of a rotor according to an alternative embodiment of this invention.
Figure 6:
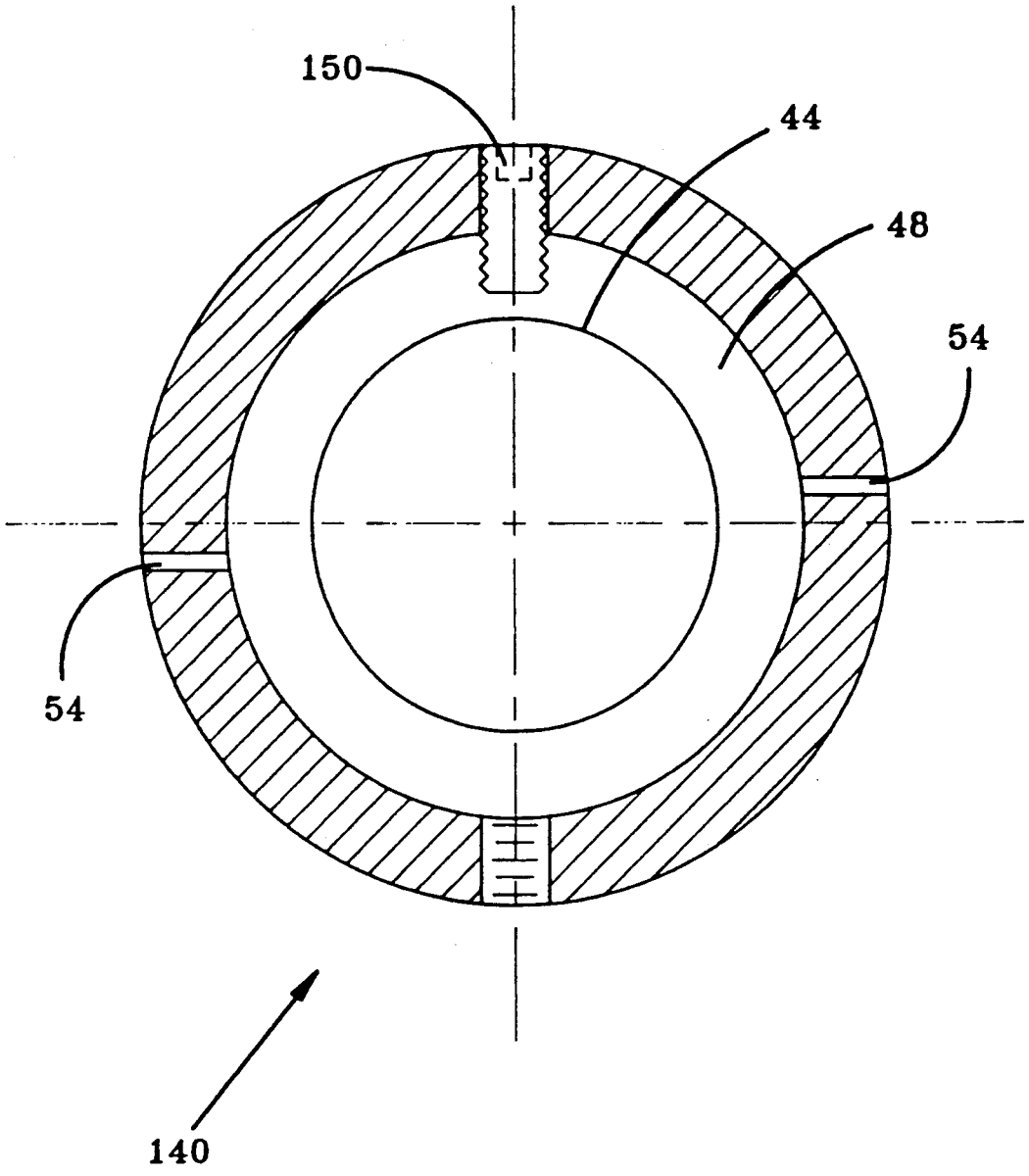
FIG. 6 is a cross-sectional view along line 6—6 of FIG. 5.

A rotor 140 according to an alternative embodiment of this invention is shown in FIGS. 5 and 6. Rotor 140 is similar to rotor 40 of FIG. 3, except that a pair of set screws 150 replace restrictor pins 50. These set screws 150 extend radially inwardly from the outside wall of enlarged portion 46 at its maximum diameter (i.e. at midplane M) into annular channel 48. The tips of screws 150 are close to the outside surface of stem 26. The axes of the screws 150 are coplanar and are perpendicular to central axis A. The screws are 180° apart. (More than 2 screws may be used, but should be equiangularly spaced). A pair of orifices 54, slightly off center (to cause rotor 140 to rotate), 180° apart, and preferably in midplane M, extend from annular channel 48 to the exterior of the nozzle. Otherwise, rotor 140 is like rotor 40 and comprises two cylindrical end portions 42 having a central bore 44, and a central portion 46 of enlarged diameter and of arcuate outside wall configuration and having an annular channel 48 therein. Set screws 150 extend into channel 48, and serve as flow restrictors which momentarily obstruct flow of high pressure water from ports 32 of body 20 into channel 48 as the rotor 40 rotates. This momentary periodic obstruction reduces the rotation speed of rotor.

Spray nozzle 10 is preferably made of heat treated stainless steel in order to assure long life. [The bearing surface which come into contact with the rotor, i.e.] The outside surface of the stem portion 26 of body 20 is preferably heat treated and chrome plated for maximum wear. All parts except cap screw 70 are preferably heat treated. Body 20, end cap 60, screw 70 and the flow restrictors (pins or screws) are preferably made of stainless steel for long life and only the bearing surfaces thereof (as previously noted) need to be chrome plated.

The exact configuration of the orifices 54 may be varied to suit the particular use to which the nozzle is intended. Among the uses for which the nozzle is suitable are water blasting, chemical cleaning, steam cleaning and internal pipe cleaning. Concave and irregular surfaces, as well as flat and convex surfaces, can be cleaned with the nozzle of this invention.

Figure 7:
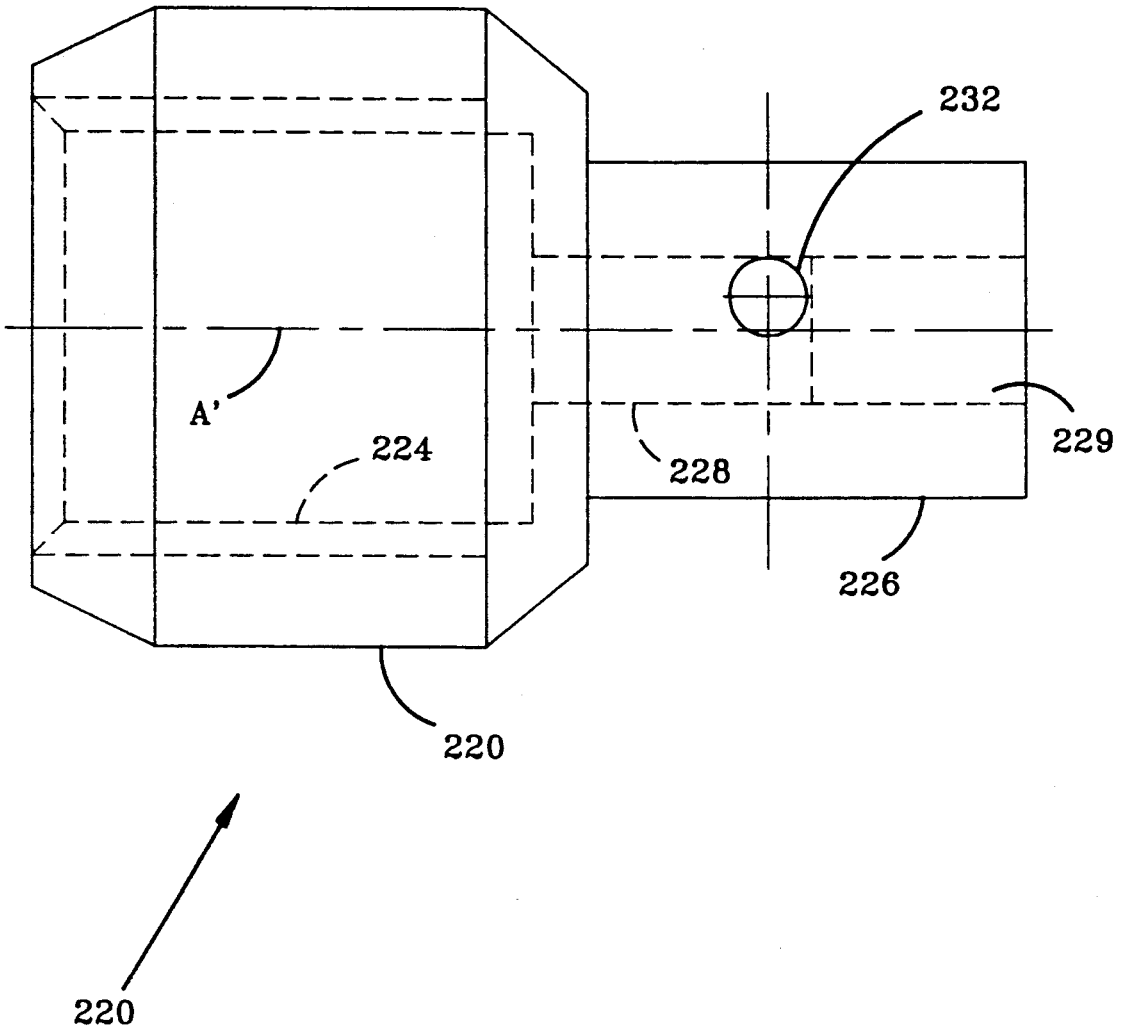
FIG. 7 is a side elevational view of a spray nozzle body according to an alternate embodiment of this invention.
Figure 8:
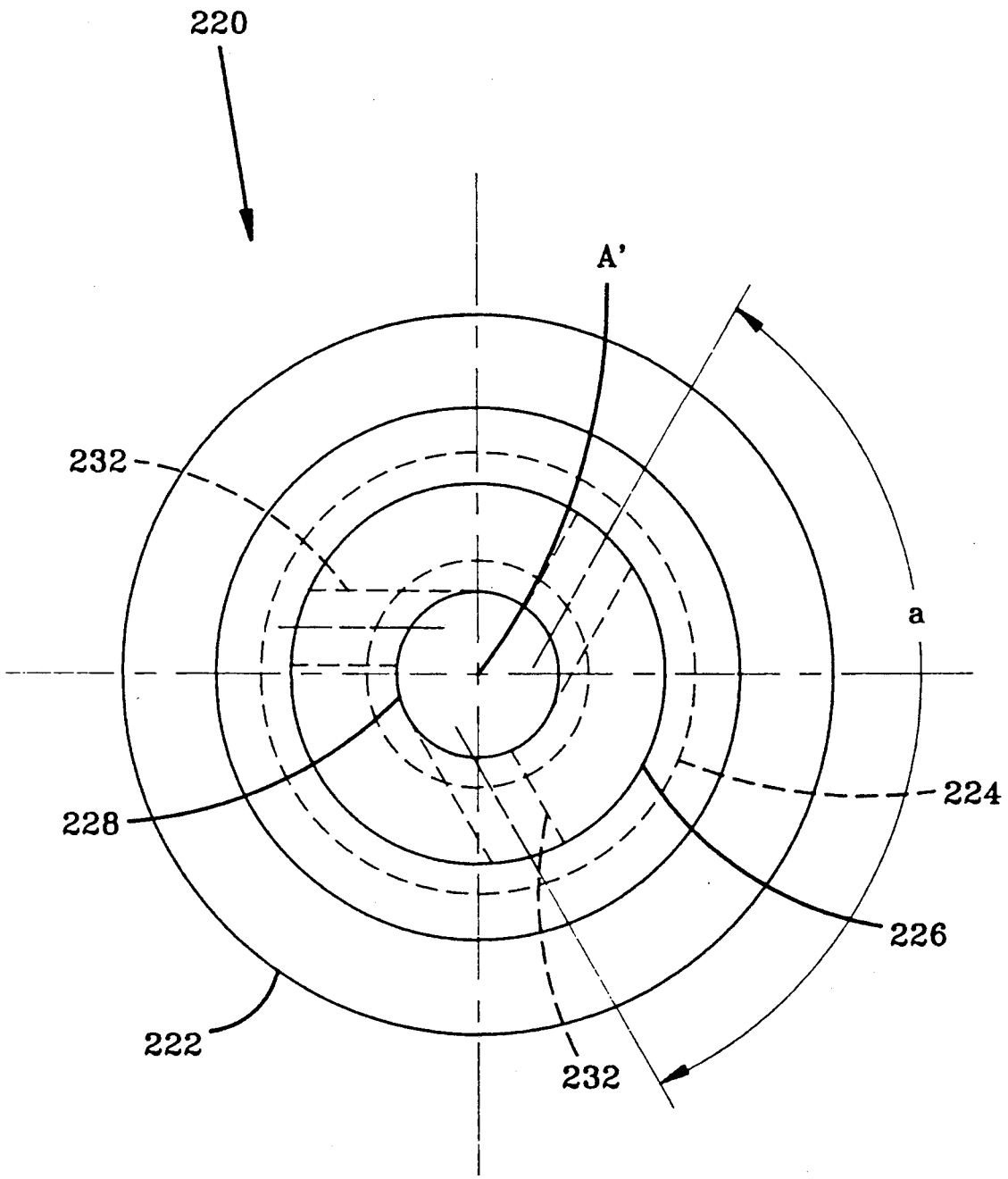
FIG. 8 is an end view of a nozzle body according to the embodiment shown in FIG: 5, as seen from the outlet end.

A body 220 according to an alternative embodiment of this invention is illustrated in FIGS. 7 and 8. Referring now to FIGS. 7 and 8, annular body 220 has an inlet portion 222 with a bore 224, preferably internally screw-threaded, therein, and a tubular outlet or stem portion 226, of smaller external diameter than that of the inlet portion 222, extending therefrom. Outlet portion 226 includes a counterbore 228 which is concentric with bore 224. Both are centered on a central axis A.

An end wall or plug 229, which may be of appreciable thickness, closes the end of tubular stem portion 226 which is remote from inlet portion 222. Counterbore 228 terminates at end wall 229.

A plurality of orifices 232 (3 are shown) extend tangentially laterally through the wall of tubular outlet portion 126 from counterbore 128 to the exterior surface of this tubular outlet portion 226. This directs high-pressure water from the counterbore 228 into annular channel 48 of a rotor 40 or 140 as previously described. Orifices 232, instead of extending radially from the counterbore 128 as do their counterparts 32 in FIGS. 1–4, are offset so that the respective axes of these ports 132 are disposed along chords rather than along diameters or radii of the tubular portion 226. The respective axes of ports 132 are coplanar and are in a plane which is perpendicular to the central axis A'. The axes of ports 232 are equiangularly spaced by an angle a which is 120° (the value of a is 360° divided by the number of ports).

The rotor to be used with body 220 may be as shown in either FIG. 3 or FIG. 5. Alternatively, a rotor in which no flow restrictors are provided may be used.

The rotor may be restrained from axial movement by desired means, such as a flat plate, either with or without a rim at its circumference, which is attached (as with screws or bolts) to the closed end 129 of body 120.

One of the advantages of a nozzle according to this invention is that it is highly versatile. It can be used to clean internal surfaces, even those of irregular shape which are difficult to clean with presently known spray nozzles. Another advantage of the nozzle of this invention is that the orifices may be configured for relatively slow rotation of the rotor and correspondingly high energy delivery to the surface to be cleaned, resulting in more effective dislodging of strongly adherent surface contaminants. Because of slow rotation, most of the kinetic energy of the water stream is available for delivery to the surface to be cleaned, and relatively little is lost in causing rotation of the rotor.

While this invention has been described with reference to specific embodiments thereof, it shall be understood that such descriptions are by way of illustration and not limitation.

What is claimed is:

1. A high pressure spray nozzle comprising:

(a) a body having a central axis, an inlet portion having an axial bore adapted to be connected to a tubular conduit for high pressure water, an axial counterbore in communication with said bore, a tubular stem portion through which the counterbore extends, and a plurality of ports extending laterally through said stem portion from said counterbore to the exterior of said body;

(b) an annular rotor surrounding the stem portion, said rotor having therein a bore which is in close proximity with the exterior of said stem portion, an enlarged mid-portion defining an annular channel in communication with said ports and forming a reservoir for water, and flow restrictor means extending into said channel and rotating with said rotor for periodically obstructing the flow of water through said ports into said channel as said rotor rotates, and a plurality of orifices extending through said rotor from said channel to the exterior of said rotor for discharging high pressure water, said orifices being arranged so as to cause self-rotation of said rotor; and (c) means for restraining said rotor from axial movement and for closing the end of the counterbore which is remote from said bore.

2. A spray nozzle according to claim 1 wherein said flow restrictor means comprise at least one longitudinally extending pin.

3. A spray nozzle according to claim 1 wherein said flow restrictor means comprise at least one radially extending member which extends inwardly from the exterior of said rotor into said channel.

4. A spray nozzle according to claim 3 in which said at least one member comprises a plurality of screws.

5. A spray nozzle according claim 1 wherein said ports extend radially.

6. A spray nozzle according to claim 1 wherein said ports extend essentially tangentially from said counterbore.

7. A spray nozzle according to claim 1 wherein said flow restrictor means comprise a plurality of equiangularly spaced flow restrictor members.

* * * * *